US007380473B2

(12) United States Patent
Hsieh

(10) Patent No.: US 7,380,473 B2
(45) Date of Patent: Jun. 3, 2008

(54) HAND TOOL WITH TORQUE DETECTION DEVICE

(76) Inventor: Chih-Ching Hsieh, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 11/228,438

(22) Filed: Sep. 19, 2005

(65) Prior Publication Data

US 2007/0062310 A1 Mar. 22, 2007

(51) Int. Cl.
*B25B 23/14* (2006.01)

(52) U.S. Cl. ..... 73/862.22

(58) Field of Classification Search ..... 73/862.22
See application file for complete search history.

(56) References Cited

U.S. PATENT DOCUMENTS 4,982,612 A * 1/1991 Rittmann ..... 73/862.23
5,503,028 A * 4/1996 Brihier ..... 73/862.21
6,766,700 B2 * 7/2004 Hsien ..... 73/862.21
6,779,422 B2 * 8/2004 Chen ..... 81/60
6,928,885 B1 * 8/2005 Shiao et al. ..... 73/862.21
6,948,380 B1 * 9/2005 Shiao et al. ..... 73/862.21
7,062,978 B1 * 6/2006 Hsien ..... 73/862.21
7,089,807 B2 * 8/2006 Hsieh ..... 73/862.22
7,096,747 B1 * 8/2006 Hsieh ..... 73/862.22
7,104,144 B1 * 9/2006 Hsieh ..... 73/862.21
7,263,902 B2 * 9/2007 Hsieh ..... 73/862.21

* cited by examiner

*Primary Examiner*—Max Noori

(57) ABSTRACT

A hand tool includes a handle and a function end wherein a driving member is rotatably engaged with a through hole defined in the function end so as to output a torque to tighten or loosen an object. A ratchet mechanism including a pawl for engaging with the driving member is connected to the function end and two ends of the pawl member are alternatively in contact with two end walls of a recess for receiving the pawl member. Two detection members are respectively connected to the two end walls of the recess so that when outputting torque, the two ends of the pawl member contact against the two detection members which are piezo-electric switches and electrically connected to a data processing unit and a display unit connected to the handle.

8 Claims, 5 Drawing Sheets

HAND TOOL WITH TORQUE DETECTION DEVICE

FIELD OF THE INVENTION

The present invention relates to a hand tool having at least one torque detection member located at a position where output torque directly applies to the detection member and the torque is displayed on a display unit on the handle.

BACKGROUND OF THE INVENTION

A conventional hand tool for output a torque to tighten or loosen an object generally includes a handle and a function end which can be a box end or a wrench head. The object is engaged with the function end and the user holds the handle and rotates the handle. The user feels that the object is tightened enough and stops the rotation. However, the user cannot know the actual torque that is applied to the object. In some precision machine, the torque for each bolt is accurately calculated so that the assemblers have to use a torque detection device to control the torque that is applied to the object. U.S. Pat. No. 3,970,155 discloses a hand tool that includes two strain gauges and a display unit. The strain gauges are located in the handle so as to detect the deformation of the handle and transfer the deformation into digits which are displayed in the display unit. Nevertheless, the positions of the strain gauges affect the torque that is detected by the strain gauges. In other words, the value displayed in the display unit is only a rough value at the positions of the strain gauges, rather than at the function end.

The present invention intends to provide a hand tool that includes at least one detection member located at the function end so that the output torque is applied to the detection member.

SUMMARY OF THE INVENTION

The present invention relates to a hand tool that comprises a handle and a function end which includes a through hole so that a driving member is rotatably engaged therewith. A recess is defined in the function end and communicates with the through hole. A pawl member is movably received in the recess and engaged with the driving member. The pawl member can be shifted by pushing a control member and two ends of the pawl member alternatively contact two end walls of the recess when outputting torque in different directions. Two detection members are respectively connected to the two end walls of the recess and the two ends of the pawl member contact against the two detection members when outputting torque. A data processing unit and a display unit are connected to the handle and electrically connected to the two detection members.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
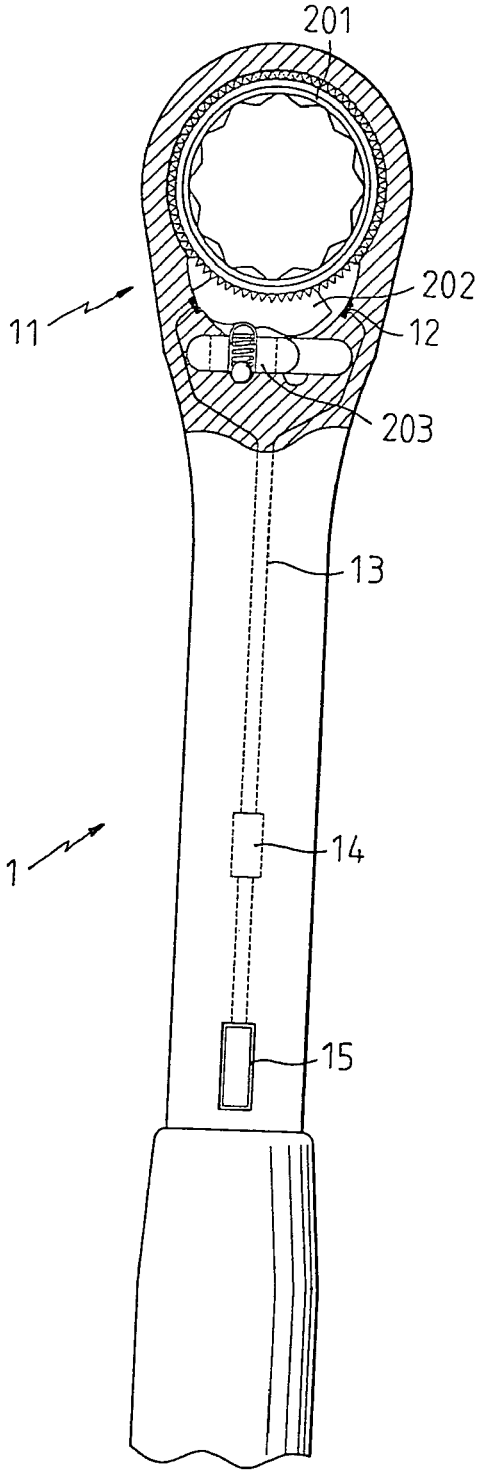
FIG. 1 is a cross sectional view to show that the pawl member is shifted to left end wall of the recess of the first embodiment of the hand tool of the present invention.
Figure 2:
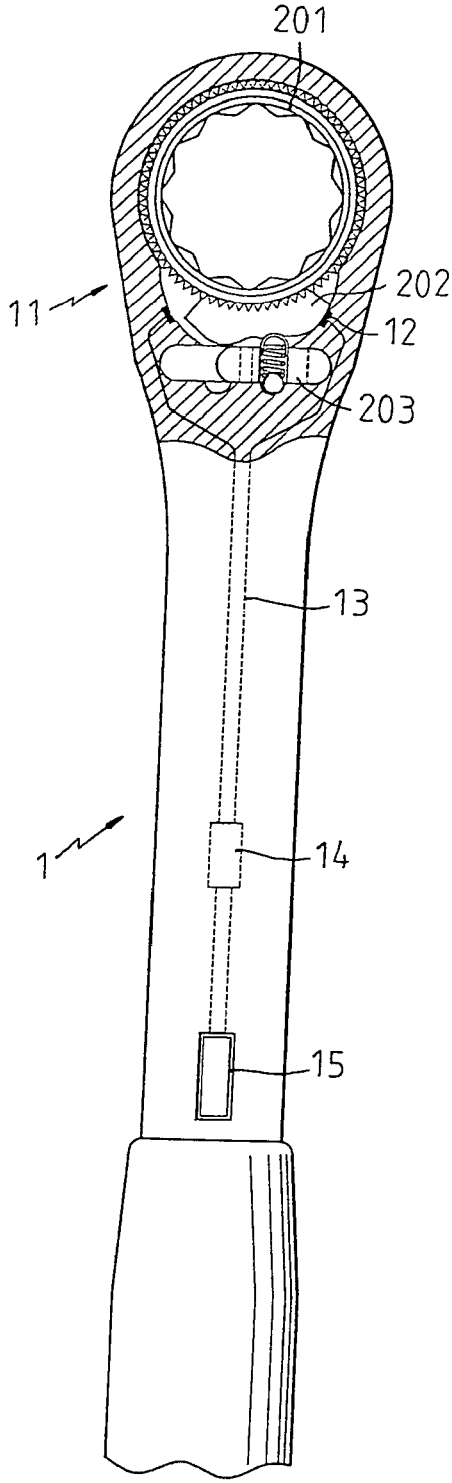
FIG. 2 is a cross sectional view to show that the pawl member is shifted to right end wall of the recess of the first embodiment of the hand tool of the present invention.

Referring to FIGS. 1 and 2, the hand tool of the present invention comprises a handle 1 and a function end 11 which includes a driving member 201 rotatably engaged with a through hole defined in the function end 11. A recess is defined in the function end 11 and communicates with the through hole. A ratchet mechanism is connected to the function end 11 and includes a pawl member 202 movably received in the recess. The pawl member 202 includes a toothed side which is engaged with toothed outer periphery of the driving member 201. A control member 203 is connected to the pawl member 202 so as to shift the pawl member 202 left and right. The control member 203 includes a spring and a bead which is biased by the spring and engaged with one of two notches of the pawl member 202 to position the pawl member 202. The recess includes two end walls and two ends of the pawl member 202 may alternatively contact the two end walls as shown in FIGS. 1 and 2. When the left end of the pawl member 202 is in contact with the left end wall of the recess, the handle 1 can be rotated counter clockwise to output a torque. When the right end of the pawl member 202 is in contact with the right end wall of the recess, the handle 1 can be rotated clockwise to output a torque.

Two detection members 12 which are piezo-electric switches, are respectively connected to the two end walls of the recess so that when outputting a torque, the pawl member 202 that is in contact with the pawl member 202 is applied by the reaction force from the driving member 201. A data processing unit 14 and a display unit 15 are connected to the handle 1 and electrically connected to the two detection members 12. Therefore, when the detection members 12 are applied by a torque, they send a signal to the data processing unit 14 which calculates and processes the signal and transfers the result into digits of the value of the torque and the value of the torque is displayed in the display unit 15.

Figure 3:
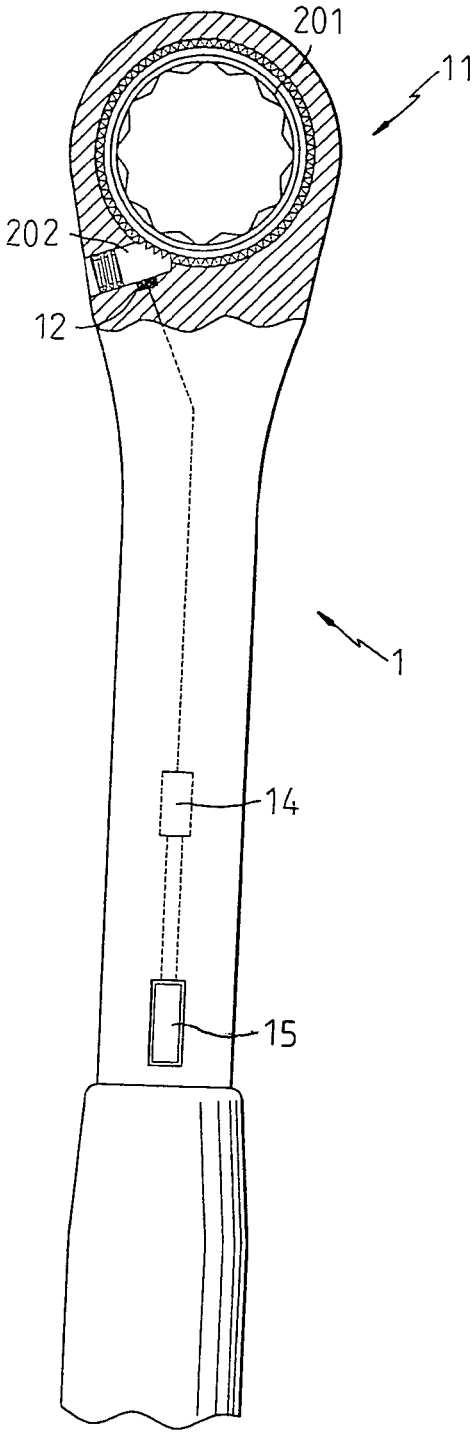
FIG. 3 is a cross sectional view to show the second embodiment of the hand tool of the present invention.

FIG. 3 shows a second embodiment of the present invention which a handle 1 and a function end 11 which has a driving member 201 rotatably engaged with a through hole defined in the function end 11. A recess defined in the function end 11 and communicates with the through hole and an outer periphery of the function end 11. A pawl member 202 is movably received in the recess and an end member seals the recess to prevent the pawl member 202 from dropping out from the recess. The pawl member 202 includes a toothed side which is engaged with a toothed outer periphery of the driving member 201. A detection member 12 such as a piezo-electric switch is connected to an inner periphery of the recess and the pawl member 202 contacts the detection member 12 when outputting torque. A data processing unit 14 and a display unit 15 are connected to the handle 1 and electrically connected to the detection member 12.

Figure 4:
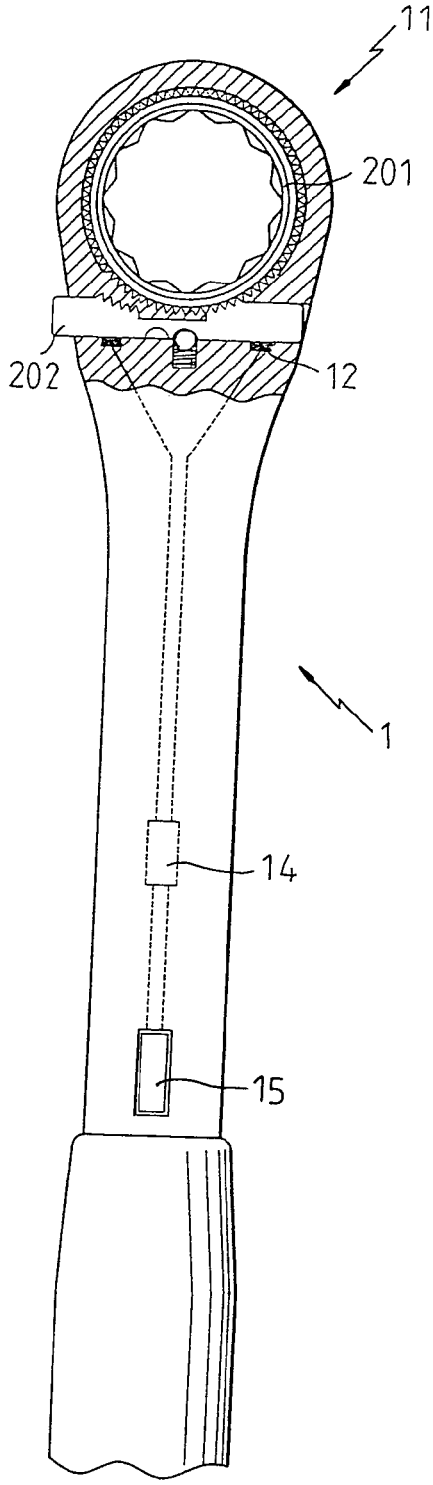
FIG. 4 is a cross sectional view to show the third embodiment of the hand tool of the present invention.

FIG. 4 shows that the hand tool comprises a handle 1 and a function end 11 which includes a driving member 201 rotatably engaged with a through hole defined in the function end 11. A passage is defined transversely through the function end 11 and communicates with the through hole and two sides of the function end 11. A cylindrical pawl member 202 is movably engaged with the passage and engaged with the driving member 201. The pawl member 202 includes two toothed portions which are alternatively engaged with a toothed outer periphery of the driving member 201 by pushing either ends of the pawl member 202. Two detection members 12 such as piezo-electric switches are respectively connected to an inner periphery of the passage and the pawl member 202 contacts the two detection members 12 when outputting torque. A data processing unit 14 and a display unit 15 are connected to the handle 1 and electrically connected to the two detection members 12.

Figure 5:
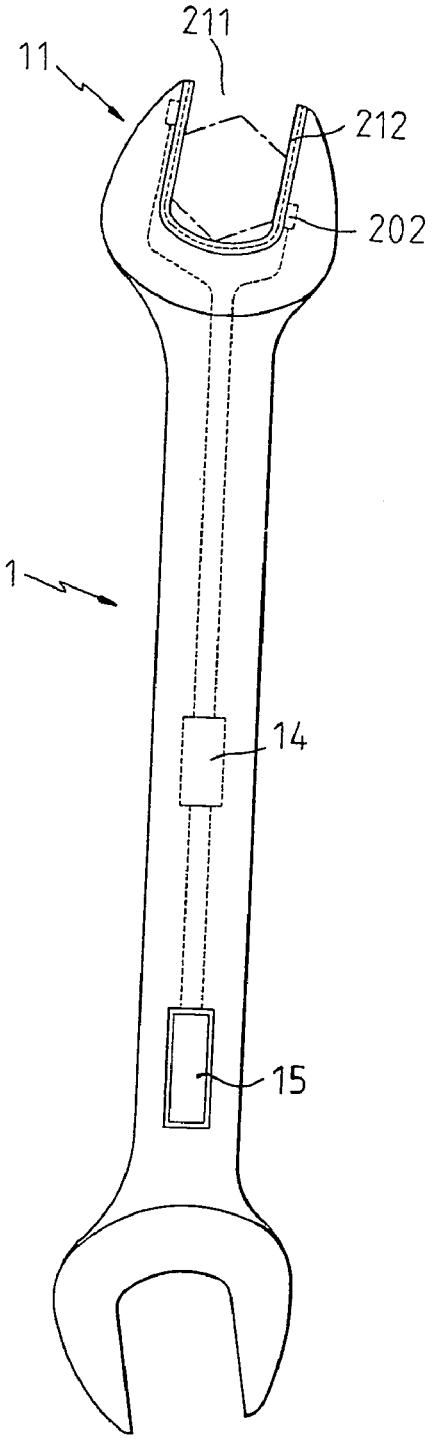
FIG. 5 shows the fourth embodiment of the hand tool of the present invention.
Figure 6:
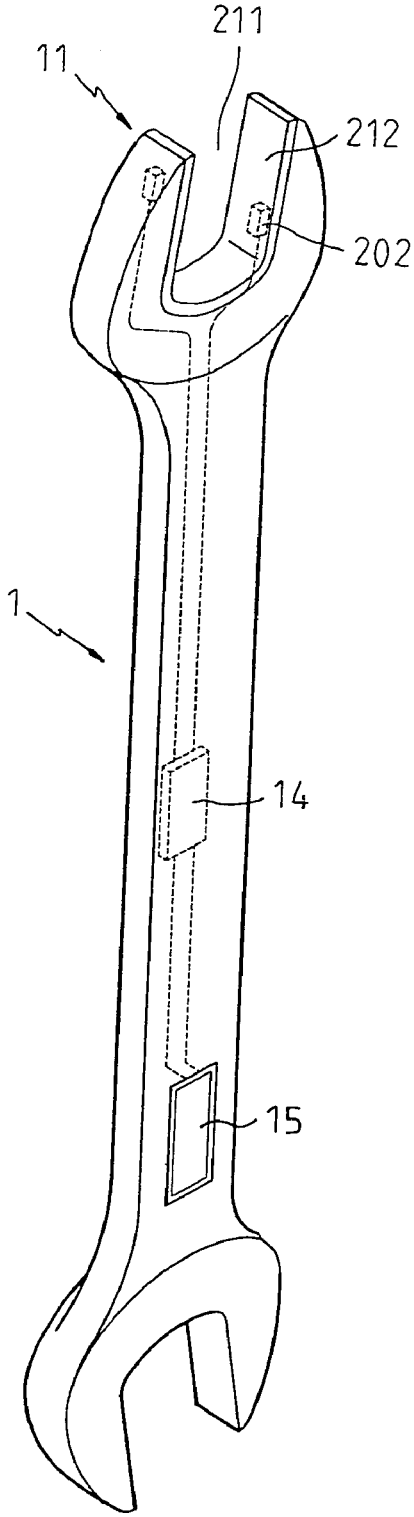
FIG. 6 is a perspective view of the fourth embodiment of the hand tool of the present invention.

FIGS. 5 and 6 shows that the hand tool includes a handle 1 and two function ends 11. Each of the two function ends 11 includes two jaws between which a U-shaped clamp space 211 is defined. The two jaws have two respective clamping surfaces 212 and two detection members 202 such as piezo-electric switches are connected to the two respective clamping surfaces 212 of the two jaws. A data processing unit 14 and a display unit 15 are connected to the handle 1 and electrically connected to the detection members 12. When an object is clamped between the two clamping surfaces 212 of the two jaws, at least one of the two detection members 202 is applied by the torque applied to the object.

Figure 8:
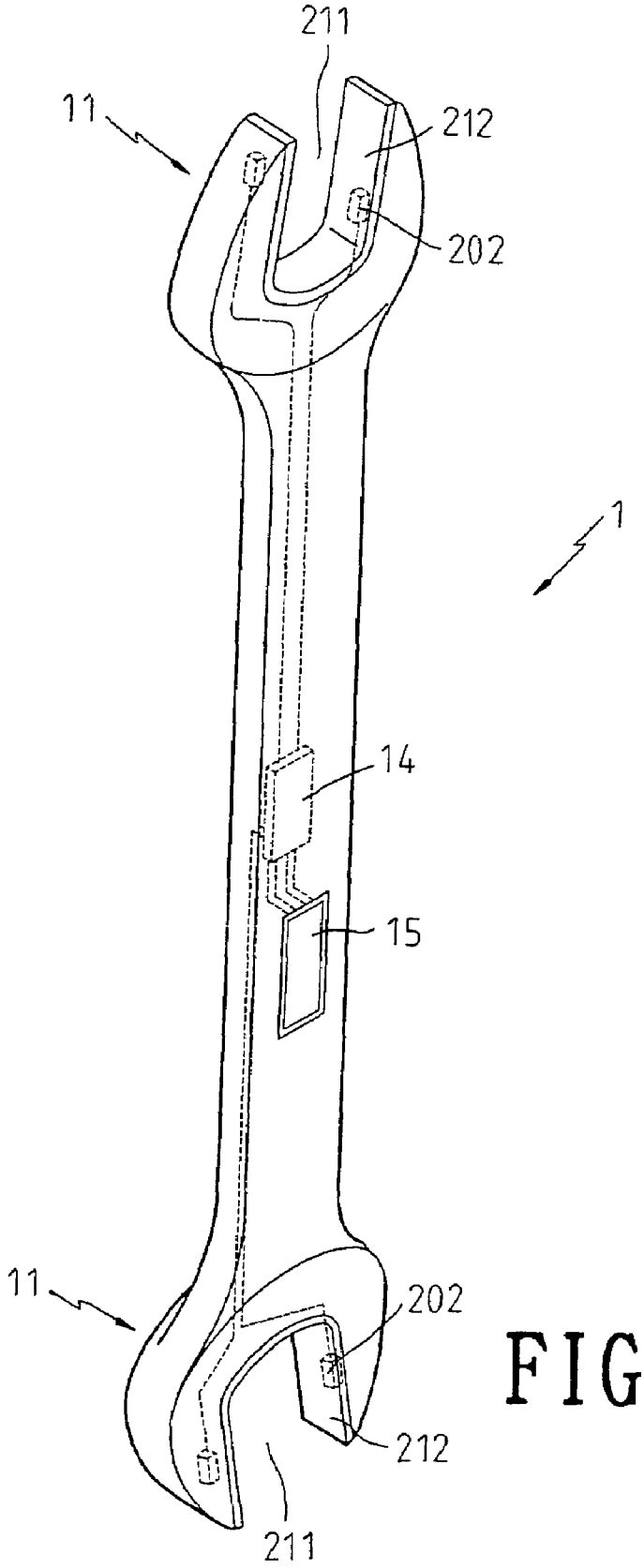
FIG. 8 shows the sixth embodiment of the hand tool of the present invention.

FIG. 8 shows that the two function ends 11 each have two detection members 202 which are electrically connected to the data processing unit 14 and the display unit 15.

Figure 7:
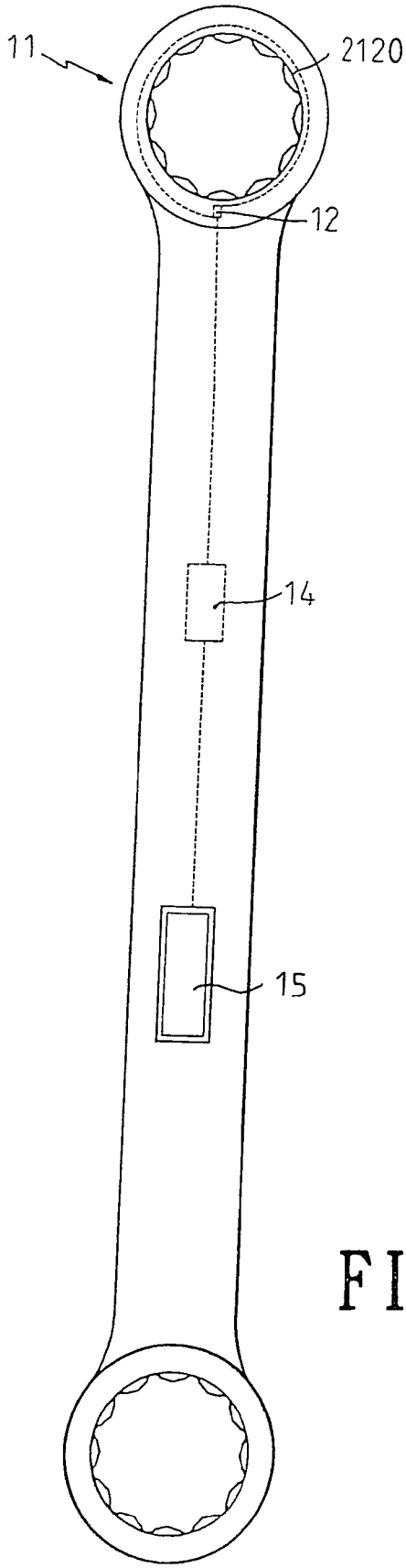
FIG. 7 shows the fifth embodiment of the hand tool of the present invention.

FIG. 7 shows that the hand tool comprises a handle 1 and a function end 11 which is a box end having a hole defined therethrough. A retaining ring member 2120 is engaged with the hole and has a spiral outer periphery. A distance is defined between a start point of the spiral outer periphery and a final point of the spiral outer periphery. A detection member 12 such as a piezo-electric switch is connected to an end surface between the start point of the spiral outer periphery and the final point of the spiral outer periphery. A data processing unit 14 and a display unit 15 are connected to the handle 1 and electrically connected to the detection member 12. When the retaining ring member 2120 is mounted to an object and applies a torque to the object, the detection member 12 is applied a reaction force of the torque so that the value of the torque can be detected and displayed in the display unit 15.

While we have shown and described the embodiment in accordance with the present invention, it should be clear to those skilled in the art that further embodiments may be made without departing from the scope of the present invention.

What is claimed is:

1. A hand tool comprising:

a handle and a function end which includes a driving member rotatably engaged with a through hole defined in the function end, a recess defined in the function end and communicating with the through hole, a pawl member movably received in the recess and engaged with the driving member, a control member connected to the pawl member so as to shift the pawl member, the recess including two end walls and two ends of the pawl member alternatively contacting the two end walls;

two detection members respectively connected to the two end walls of the recess and the two ends of the pawl member contacting against the two detection members when outputting torque, and a data processing unit and a display unit connected to the handle and electrically connected to the two detection members.

2. The hand tool as claimed in claim 1, wherein the two detection members are piezo-electric switches.

3. A hand tool comprising:

a handle and a function end which includes a driving member rotatably engaged with a through hole defined in the function end, a recess defined in the function end and communicating with the through hole and an outer periphery of the function end, a pawl member movably received in the recess and engaged with the driving member;

a detection member connected to an inner periphery of the recess and the pawl member contacting the detection member when outputting torque, and a data processing unit and a display unit connected to the handle and electrically connected to the detection member.

4. The hand tool as claimed in claim 3, wherein the detection member is a piezo-electric switch.

5. A hand tool comprising:

a handle and a function end which includes a driving member rotatably engaged with a through hole defined in the function end, a passage defined transversely through the function end and communicating with the through hole, a pawl member movably engaged with the passage and engaged with the driving member;

two detection members respectively connected to an inner periphery of the passage and the pawl member contacting the two detection members when outputting torque, and a data processing unit and a display unit connected to the handle and electrically connected to the two detection members.

6. The hand tool as claimed in claim 5, wherein the two detection members are piezo-electric switches.

7. A hand tool comprising:

a handle and a function end which is a box end having a hole defined therethrough, a retaining ring member engaged with the hole and having a spiral outer periphery, a distance defined between a start point of the spiral outer periphery and a final point of the spiral outer periphery, a detection member connected to an end surface between the start point of the spiral outer periphery and the final point of the spiral outer periphery, and a data processing unit and a display unit connected to the handle and electrically connected to the detection member.

8. The hand tool as claimed in claim 7, wherein the detection member is a piezo-electric switch.

* * * * *